US009230436B2

(12) United States Patent
Fowe et al.

(10) Patent No.: US 9,230,436 B2
(45) Date of Patent: Jan. 5, 2016

(54) DYNAMIC LOCATION REFERENCING SEGMENT AGGREGATION

(71) Applicant: HERE Global B.V., Veldhoven (NL)

(72) Inventors: James Fowe, Evanston, IL (US); Garvil Giurgiu, Chicago, IL (US); Leon Stenneth, Chicago, IL (US)

(73) Assignee: HERE Global B.V., Veldhoven (NL)

( * ) Notice: Subject to any disclaimer, the term of this patent is extended or adjusted under 35 U.S.C. 154(b) by 36 days.

(21) Appl. No.: 14/073,092

(22) Filed: Nov. 6, 2013

(65) Prior Publication Data

US 2015/0127244 A1 May 7, 2015

(51) Int. Cl.
*G08G 1/01* (2006.01)
*G08G 1/09* (2006.01)

(52) U.S. Cl.
CPC ..... *G08G 1/093* (2013.01); *G08G 1/0112* (2013.01); *G08G 1/0116* (2013.01); *G08G 1/0133* (2013.01); *G08G 1/0141* (2013.01); *G08G 1/091* (2013.01)

(58) Field of Classification Search
None
See application file for complete search history.

(56) References Cited

U.S. PATENT DOCUMENTS

| | | | | |
|---|---|---|---|---|
| 5,182,555 | A * | 1/1993 | Sumner | 340/905 |
| 6,038,559 | A | 3/2000 | Ashby et al. | |
| 6,633,808 | B1 | 10/2003 | Schulz et al. | |
| 6,861,960 | B2 | 3/2005 | Hessing et al. | |
| 6,963,799 | B2 | 11/2005 | Kita et al. | |
| 7,096,115 | B1 | 8/2006 | Groth et al. | |
| 7,587,186 | B2 | 9/2009 | Duckeck | |
| 7,671,764 | B2 * | 3/2010 | Uyeki et al. | 340/995.13 |
| 8,041,503 | B2 * | 10/2011 | Choi et al. | 701/117 |
| 8,086,394 | B2 | 12/2011 | Kim et al. | |
| 8,244,451 | B2 | 8/2012 | Okude et al. | |
| 8,781,716 | B1 * | 7/2014 | Wenneman et al. | 701/118 |
| 2007/0038363 | A1 | 2/2007 | McGrath | |
| 2007/0203638 | A1 * | 8/2007 | Tooyama et al. | 701/200 |

(Continued)

FOREIGN PATENT DOCUMENTS

| | | | |
|---|---|---|---|
| EP | 0943895 | A2 | 9/1991 |
| EP | 1022704 | A1 | 7/2000 |

(Continued)

OTHER PUBLICATIONS

"Intelligent Transport Systems—Location Referencing for Geographic Databases —Part 3: Dynamic Location Referencing (Dynamic Profile)", International Standard—ISO, Zuerich, Sep. 1, 2007, pp. 1-87.

(Continued)

*Primary Examiner* — Thomas Tarcza
*Assistant Examiner* — Richard Goldman
(74) *Attorney, Agent, or Firm* — Lempia Summerfield Katz LLC

(57) ABSTRACT

In one embodiment, road segments are aggregated for DLR. A plurality of connected road segments and corresponding traffic information for each of the connected road segments are identified. A processor aggregates the connected road segments into a fewer number of dynamic location reference (DLR) segments than the plurality. By testing different possible combinations, road segments with similar congestion are grouped. The processor calculates a traffic value for each of the DLR segments. Each traffic value is a function of the traffic information for the connected road segments of the respective DLR segment. An indicator of the aggregated DLR segment and the traffic value for at least one of the DLR segments is output.

18 Claims, 4 Drawing Sheets

(56) References Cited

U.S. PATENT DOCUMENTS

| | | | | |
|---|---|---|---|---|
| 2007/0208492 | A1* | 9/2007 | Downs et al. | 701/117 |
| 2007/0208497 | A1* | 9/2007 | Downs et al. | 701/117 |
| 2008/0071465 | A1* | 3/2008 | Chapman et al. | 701/117 |
| 2008/0071466 | A1* | 3/2008 | Downs et al. | 701/117 |
| 2009/0030596 | A1* | 1/2009 | Okude et al. | 701/117 |
| 2010/0145569 | A1* | 6/2010 | Bourque et al. | 701/33 |
| 2010/0286899 | A1* | 11/2010 | Jain et al. | 701/119 |
| 2011/0257883 | A1* | 10/2011 | Kuznetsov | 701/209 |
| 2012/0128214 | A1* | 5/2012 | Satoh | 382/113 |
| 2012/0239281 | A1* | 9/2012 | Hinz | 701/117 |
| 2012/0316765 | A1 | 12/2012 | Marko | |
| 2013/0030611 | A1* | 1/2013 | Constans et al. | 701/7 |
| 2013/0030692 | A1* | 1/2013 | Hagan | 701/410 |
| 2013/0046456 | A1* | 2/2013 | Scofield et al. | 701/117 |
| 2014/0038640 | A1* | 2/2014 | Wesselius et al. | 455/456.1 |
| 2014/0100766 | A1* | 4/2014 | Masutani | 701/117 |
| 2014/0136088 | A1* | 5/2014 | Nikovski | 701/117 |
| 2014/0222321 | A1* | 8/2014 | Petty et al. | 701/117 |
| 2014/0266984 | A1* | 9/2014 | Sharma | 345/8 |
| 2015/0006068 | A1* | 1/2015 | Kwon et al. | 701/119 |
| 2015/0006069 | A1* | 1/2015 | Kwon et al. | 701/119 |

FOREIGN PATENT DOCUMENTS

| | | | |
|---|---|---|---|
| EP | 2166524 | A1 | 3/2010 |
| EP | 2219167 | B1 | 1/2012 |
| EP | 2500887 | A1 | 9/2012 |
| EP | 2442291 | B1 | 4/2013 |
| WO | WO2008083743 | A1 | 7/2008 |
| WO | WO2009158058 | A1 | 12/2009 |
| WO | WO2011085421 | A2 | 7/2011 |

OTHER PUBLICATIONS

European Search Report 14190004.3; dated Apr. 7, 2015.

Hiestermann, et al: "Map-Independent Location Matching Certified by the AGORA-C Standard", Transportation Reasearch. Part C, Emerging Technologies, Pergamon, New York, NY, GB, vol. 16, No. 3, pp. 307-319; Jun. 1, 2008.

* cited by examiner between '2012-04-15 14:50:00' and '2012-04-15 14:55:00'

| LinkID | Dir | Speed(kph) | JF < 0.7 | FC | Strand ID | Index |
|---|---|---|---|---|---|---|
| 727448757 | F | 31.1874 | 0.649738 | 4 | 552622485808661947 1 | 11 |
| 727448756 | F | 30.2745 | 0.630719 | 4 | 552622485808661947 1 | 12 |
| 757116820 | F | 12.2491 | 0.25519 | 4 | 552622485808661947 1 | 13 |
| 757116819 | F | 11.5347 | 0.240306 | 4 | 552622485808661947 1 | 14 |
| 727451614 | F | 25.6558 | 0.534496 | 4 | 552622485808661947 1 | 15 |
| 727451613 | F | 10.5147 | 0.219056 | 4 | 552622485808661947 1 | 16 |

DYNAMIC LOCATION REFERENCING SEGMENT AGGREGATION

FIELD

The following disclosure relates to dynamic location referencing (DLR) for real-time vehicular traffic data.

BACKGROUND

Real-time road traffic information from traffic providers is reported using the Traffic Message Channel (TMC) addressing scheme to map traffic conditions to road-segments. However, some roads are not TMC encoded and do not have TMC identification, making it challenging to report traffic information on these roads. For example, non-expressway roads in the United States (e.g., Madison Street in the city center of Chicago Ill.) or Europe and many roads in developing countries do not have TMC encoding. One way to report traffic on roads that do not have a TMC (i.e., off-TMC) is to use the dynamic location reference (DLR) specification of the Transport Protocol Expert Group (TPEG). In DLR, latitude/longitude and shape points of links are used to identify the road segment with which traffic information is associated.

SUMMARY

In one embodiment, the segments are aggregated for DLR. A plurality of connected road segments and corresponding traffic information for each of the connected road segments are identified. A processor aggregates the connected road segments into a fewer number of dynamic location reference (DLR) segments than the plurality. The processor calculates a traffic value for each of the DLR segments. Each traffic value is a function of the traffic information for the connected road segments of the respective DLR segment. An indicator of the aggregated DLR segment and the traffic value for at least one of the DLR segments is output.

BRIEF DESCRIPTION OF THE DRAWINGS

Exemplary embodiments of the present invention are described herein with reference to the following drawings.

DETAILED DESCRIPTION

Figure 1:
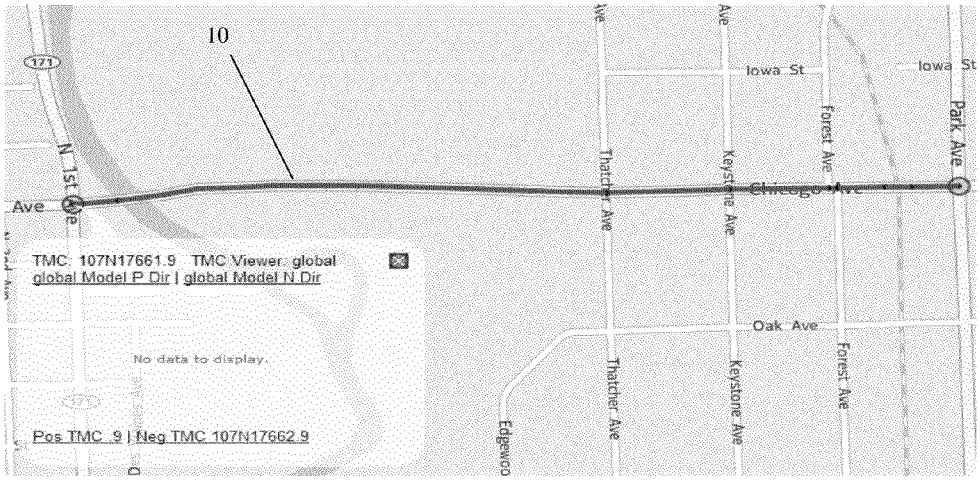
FIG. 1 (Prior Art)
FIG. 1 illustrates TMC operation according to the prior art.

TMC defines particular segments of road and contains a global identification (i.e. id) that is understood by all traffic providers and consumers. For example, FIG. 1 shows an example of a TMC defined segment 10 and the segment's identification (e.g., 107N17661.9). The TMC-defined segment 10 covers several load links or segments (e.g., $1^{st}$ Ave. to Thatcher is one link, and Thatcher to Keystone is another link) of a mapping database. Real-time traffic may be reported for this TMC-defined segment to traffic consumers. When a real-time traffic provider sends traffic information, a TMC identifier is attached. Based on the TMC identifier, the consumers may then determine with which road segments the real time traffic information is associated. However, TMC may not be available for many roads. In the Example of FIG. 1, the TMC-defined segment includes four links. To report this segment in DLR results in four sets of latitude/longitude and shape points and corresponding four measures of traffic being processed.

For DLR reporting, the data may be reduced. DLR segments are aggregated for traffic reporting. Any aggregation may be provided for DLR traffic reporting. For example, contiguous road segments with a constant or similar traffic state are aggregated. The road segments with similar traffic flow are grouped into a DLR segment. Any measure of similarity may be used. When DLR segments or links are aggregated, traffic reporting of non-TMC links becomes more efficient and more effective for both the traffic provider and the traffic consumer. After DLR aggregation, traffic providers require less server processing power to process DLR traffic data and less communication bandwidth. Traffic consumers may require less processing power to digest the incoming traffic data.

Figure 2:
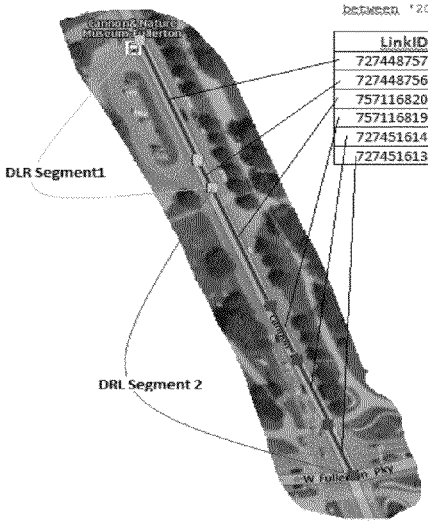
FIG. 2 illustrates an example of aggregation of road segments in DLR.

FIG. 2 shows an example of aggregation for DLR segment. The six different links are part of the same strand or collection and travel direction, but have different real-time or measured speeds. The index number in the table indicates the sequential position of each road link (e.g., a directed edge in a road network graph with directional traffic flow) on a strand (e.g., a sequence of connected road segments). The less congested links are aggregated into one DLR Segment 1, and the more congested road links are aggregated into another DLR Segment 2. The more congested links includes one link (index 15) that has less congestion, but is included to minimize the number of DLR segments. Depending on the aggregation approach, some links may be included in a same DLR segment as links with different traffic congestion. More or less refined aggregating (e.g., less or more aggressive aggregation) may be used. For reporting, the two segments (i.e., DLR Segment 1 and Segment 2) are each converted into a singleton using the member links' nodes latitude/longitude values to form the ends (e.g., begin point of link 11 and end point of link 12 for DLR Segment 1) and shape points of the linear aggregate segment.

Roughly 35% of every link with congestion in one sampling of a map database has a direct neighboring link with congestion as-well. Thus, DLR link aggregation strategies may be used to conserve resources and improve efficiency in a real-time traffic system. For off-TMC, about 50% of strands have at least two links for which traffic data is available. This sets the possibility of applying an aggregation algorithm to form one or more DLR segments.

Figure 3:
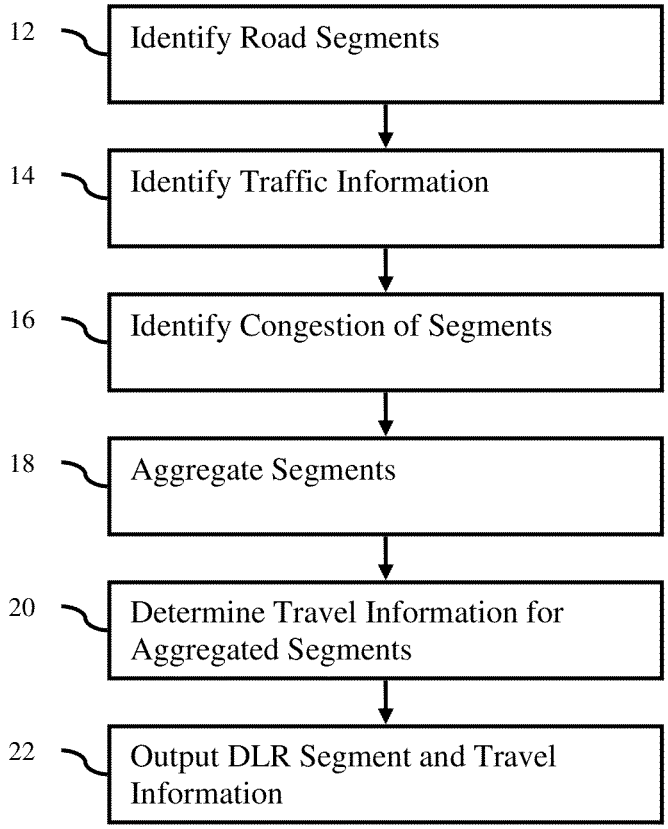
FIG. 3 is a flow chart diagram of one embodiment of a method for segment aggregation in DLR.

FIG. 3 shows a flow chart diagram of one embodiment for aggregating road segments or links for use in DLR-based traffic reporting. Map-based links or connected road segments are combined for reporting congestion. The combination is adaptive or dynamically based on the traffic flow for the road segments.

The acts of FIG. 3 are performed by a processor, such as a processor of a server. A navigation database provider and/or provider of traffic information operate the server to provide traffic information to one or more customers, such as to institutions, to a network, or to individual navigation devices. One or more of the acts may be performed by the institution, network, or the navigation devices. For example, the identification of the road segments is performed by the navigation device and provided to the server.

Additional, different, or fewer acts may be provided. For example, act 12 is not performed. As another example, act 22 is not performed. In yet another example, acts for providing information along TMC segments are included, such as where the DLR aggregation is performed only for the off-TMC parts of a map or route.

The acts are performed in the order shown or a different order. For example, acts 12 and 14 are performed as one operation where the identification of the road segments also identifies the traffic information in a database.

In act 12, a plurality of connected road segments are identified. The road segments are links or other designators of parts of roads. For example, the road segments are parts of a road as segmented in a map or navigation database. A road network G is a directed graph G=(V, E), where V is a set of nodes representing the end points of road segments and E is the set of edges (i.e., r). A road segment or line is a directed edge (e.g., unidirectional flow) in the road network graph with two end points r.start and r.end. The road between any given nodes (e.g., intersections or distance-based end points) is a road segment.

Multiple road segments are identified. For example, all the road segments to be included or included in a map are identified. As another example, road segments along a course or navigation route are identified. A navigation device, personal computer, or navigation server indicates a current or possible route, and all or some of the road segments along the route are identified. Segments associated with a current location of a vehicle may be identified instead of or in addition to along a route.

In another approach, the segments are identified based on static information. The navigation or mapping database may include designators or multiple connected road segments. For example, a strand is a sequence s of connected road segments $1<=g<n$ (e.g., $r_1, r_2, r_3, \ldots, r_n$ and $r_{(g+1)}$.start=$r_g$.end). To avoid ambiguity in identifying and grouping contiguous links for DLR, the link strands artifact or other indicator of multiple connected road segments is used as the base for finding traffic segments. Strands are unidirectional road segments that contain a concatenated set of links on that road with sequential strand indexes (e.g., integer identifiers) allocated according to links ordering in the direction of traffic flow.

The identification may be provided as part of a real-time navigation system, such as identifying in response to selection of a traffic overlay or in response to a request for traffic along a route. The segments being identified change with need or based on the end-user or other request. Alternatively, the identification is based on static indications of segments, such as using the strand information without a specific route or vehicle location. The strand is indicated in a sequential process to determine traffic information for all or a set of less than all strands.

In one embodiment, a combination of static and dynamic identification of the multiple road segments is used. The current vehicle location or route dynamically identifies one or more road segments. Any of these identified road segments that are part of a statically stored strand identifies other road segment members of the strand. The other road segments of the strand are included in the identified list of road segments.

The identified road segments are not included in TMC segments. The DLR operates off-TMC, such as in situations where TMC is not available since a given road segment is not part of a TMC segment. If TMC is available, TMC is used. Alternatively, only DLR is performed without checking for or using TMC. TMC may be used to identify the collection of road segments, but not for traffic reporting. In other embodiments, TMC is used for any parts of a route or traffic map for which TMC is available, and DLR aggregation is used for any remaining parts.

In act 14, traffic information is identified. Any traffic information may be used, such as a speed, congestion level, time per length, variance, or other indicator of traffic flow. A measure or value representing the traffic flow for each of the road segments identified in act 12 is identified. For example, FIG. 2 shows a speed for each of the connected road segments.

The identification is by looking up in a table or database. Alternatively, the traffic information is requested from a source. In yet other embodiments, the traffic information is identified by processing received data.

Any source of traffic information may be used. For example, probe data is used. Probes, cameras or other devices for monitoring traffic measure the traffic on a regular, continuous, or periodic basis. The probe data is acquired, accessed or received. As another example, traffic information is gathered from navigation devices. Travel along the road segments by one or more navigation devices, such as cellular phones, is used to measure the speed or other characteristic of congestion. Combinations of sources may be used, such using different sources for different road segments.

Traffic information is provided for each of the identified traffic segments. Where data is not available for a given road segment, the data may be interpolated from adjacent road segments, the source changed to a source with available data, or substitute (e.g., historical measures for a time period) information is used.

If more than one measure or value is available for a road segment, then measures may be combined, such as by averaging. For example, the traffic information is an average speed provided from tens, hundreds or thousands of navigation devices or probe measures within a time period.

The traffic information is dynamic. For example, FIG. 2 shows traffic information as measured in or for a five minute window. Longer or shorter windows may be used. The traffic information is substantially real-time. Substantially accounts for an hour or less range. The traffic information is measured within a short time period, such as within one hour of having received the request for traffic mapping. In other embodiments, historical or historical and current traffic information are used. For example, the traffic for a given road segment may be about the same based on a yearly, monthly, or weekly analysis (e.g., traffic information for 2:35 pm on every Tuesday). Past measures are used to represent current traffic.

Figure 4:
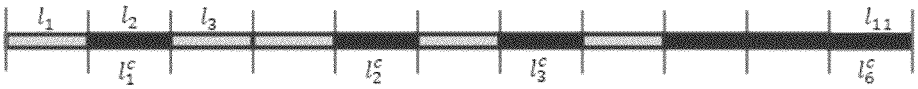
FIG. 4 illustrates an example strand of connected road segments and corresponding traffic levels.

In act 16, a level of congestion or other level of traffic flow is identified. In one embodiment, the traffic information identifies the level without change. In other embodiments, the traffic information is mapped to two or more different ranges. For a binary approach, the traffic for a road segment is designated as congested or not congested. Speeds above a certain level (e.g., speeds above five miles per hour below the speed limit) are non-congested, and lower speeds are congested. For example, FIG. 4 shows a strand or set of eleven connected road segments, $l_{1-11}$, where six of the road segments, $l^c_{1-6}$, are congested, as indicated by darker shading. Other thresholds or approaches for identifying congested or non-congested may be used.

Referring again to FIG. 3, the connected road segments are aggregated into a fewer number of dynamic location reference (DLR) segments than the number of road segments. For example, the eleven road segments of FIG. 4 are aggregated to provide ten or fewer DLR segments for the same strand or part of the road. As another example, at least five connected road segments are aggregated into at most ⅔ as many DLR segments (e.g., three or fewer DLR segments for five initial connected road segments). Any division may be used, depending on the level of aggregation desired.

The aggregation is based on the traffic information. The traffic information identified in act 14 is used, or information derived there from (e.g., the congestion level) is used to determine which links to aggregate together. Since the traffic information may change over time, the DLR segments may likewise change over time. Different DLR segments may be provided for the same strand at different times.

Any aggregation approach may be used. For example, a region growing approach is applied where a largest of possible continuous congested segment regions is grown equally with a largest of possible continuous non-congested segment regions until reaching a same segment. Clustering approaches may be used. Each DLR segment is formed from continuous or connected links, but approaches using discontinuous links may be used.

In one embodiment, the road segments are grouped as a function of a ratio of a sum of lengths of the road segments with the congestion label to a sum of lengths of the road segments with the non-congestion label. To find an optimal division of the connected road links, different possible combinations may be attempted. For example, a function Ratio(S(k,x)) returns a value of this ratio.

function Ratio($S(k, x)$) is:

$$B = \text{set of links in } L \text{ between } l_k \ \& \ l_{x+k}$$

$$\text{return}\left[\frac{\text{sum(lenghts of all } l_k^c \in S(k, x))}{\text{sum(lenghts of all } l_i \in B)}\right]$$

end Ratio

The function Ratio(S(k,x)) computes and returns the ratio value of the segment S(k,x) where k is the count along the links (e.g., k=3 for $l_3$ in the example of FIG. 4), and x is the number of link steps along the links (e.g., S(3, 3) reads on starting at $l_3$ going three more links to $l_6$). This k and x designation is used to define possible groups of segments that may be considered. k indexes the links regardless of congestion, and x is incremented in any step size, such as being initially set to one. Other definitions of the possible groups may be used. In the example ratio calculation, the denominator sums the length of all links $l_i \epsilon L$ within the traffic collection (e.g., all connected road segments of the strand), while the numerator sums the length of only congested links $l_k^c \epsilon L^c$.

The ratio is compared to a threshold. A threshold is used to identify when the ratio is associated with a combination of links that may be aggregated. The function mandates that the ratio of the congested links to the total links length must be greater than the threshold (e.g., a congestion coverage ratio (CCR) threshold). The CCR is a system parameter that balances the tradeoff between combining congested road links with non-congested road links. For example, if Ratio(S(k,x)) returns 50%, it implies that the sum of the length of the congested links is half of the sum of the length of all the segments between index k and k+x. The possible combination has the same length of congested to non-congested travel.

Any threshold may be used, such as 55%, 56%, 70%, or other value. The threshold is user set, predetermined, or adaptive. For example, the threshold becomes more permitting for greater aggregation during high computational load times. The runtime complexity of the ratio is O(m), where m is the number of segments in the denominator.

A processor calculates a ratio of congested links to total links for each of different groupings of the collection of connected road segments. The grouping for aggregation is based on a comparison of the ratios for different possible groupings to the threshold. Some possible groupings are selected as DLR segments and other possible groupings are not. For example, given a strand or other collection of connected road segments, the processor first tests if the entire strand passes the CCR threshold. If this is true, the algorithm terminates and all of the segments are aggregated into one DLR segment having congestion on the entire strand. This achieves a run time of O(1) if the entire strand passes the CCR in the first round. Otherwise, starting from the first link ($l_1$), a subsequent neighboring link $l_2$ is added. If this grouping of two links passes the CCR ratio, then another link is added. The neighboring new links $l_3, l_4, \ldots, l_n$ continue to be added to the initial set of links if and only if the addition of the new link results in the ratio satisfying the CCR threshold. If the CCR threshold is superseded, the set of discovered links whose congestion ratio supersedes the CCR threshold is returned as a DLR segment for congestion reporting, and the processor algorithm begins again with the remaining links in the strand or collection.

Referring to FIG. 4, an example DLR segment aggregation is described using the ratio comparison to the CCR threshold. For simplicity, the length of every link in this example is treated as equal.

| Links | $l_1$ | $l_2$ | $l_3$ | $l_4$ | $l_5$ | $l_6$ | $l_7$ | $l_8$ | $l_9$ | $l_{10}$ | $l_{11}$ |
|---|---|---|---|---|---|---|---|---|---|---|---|
| Link Length | 1 | 1 | 1 | 1 | 1 | 1 | 1 | 1 | 1 | 1 | 1 |

The CCR threshold is set to 54% and the congestion is as shown in FIG. 4. The ratio function is demonstrated on the possible DLR segment covered by $l^c_1$ and $l^c_2$. $l^c_1$ is at $l_2$ and $l^c_2$ is at $l_5$, so four links are included in total with the possible DLR segment bounded by congested links. The $$\text{Ratio}(S(1, 1)) = \frac{1+1}{1+1+1+1} = 50\%.$$

The numerator indicates summation of length of the two congested links, while the denominator is the summation of all the four links. This fails the CCR threshold. Expanding to the next possible aggregation, a possible DLR segment is covered by $l^c_1$ and $l^c_3$. $l^c_1$ is at $l_2$ and $l^c_3$ is at $l_7$, so six links are included in total with the possible DLR segment bounded by congested links. The $$\text{Ratio}(S(1, 2)) = \frac{1+1+1}{1+1+1+1+1+1} = 50\%.$$

This also fails the CCR threshold. The $$\text{Ratio}(S(1, 3)) = \frac{1+1+1+1}{1+1+1+1+1+1+1+1} = 50\%$$

fails the CCR threshold. The $$\text{Ratio}(S(1,4)) = \frac{1+1+1+1+1}{1+1+1+1+1+1+1+1+1+1} = 56\%$$

passes the CCR threshold since 56%>54%.

The run time of this incremental algorithm is O(n). More efficient approaches may be used. For example, a divide-and-conquer approach may more efficiently determine the groupings for the DLR segments due to asymptotic complexity. The possible groups are limited to DLR segments beginning and ending with congestion road segments (i.e., with links labeled as congested). In the example S(k,x) function above, k is the count along the congested links (e.g., k=3 for $l^c_3$ in the example of FIG. 4), and x is the number of link steps along the congested links (e.g., S(3,3) reads on starting at $l^c_3$ and going three more congested links to $l^c_6$).

L is an ordered set of Links ($l_i$) on a strand or in a collection, and $L^c$ is an ordered set of congested links ($l_k^c$)$\forall L^c \epsilon L$.

$L=\{l_i\}\forall i=1,2,3,\ldots N$ $N$=total number of links on the strand.

$L^c=\{l_k^c\}\forall k=1,2,3,\ldots,N^c$ $N^c$=total number of links with congestion.

A set S(k,x) is defined as a traffic segment containing ordered contiguous set of links in $L^c$ from a congested link $l_k^c$ to another congested link such that total elements in the set=1+x. Other possible grouping functions may be used, including road segments groups ending and/or beginning with non-congested links.

An ordered collection of DLR segments (i.e., end result of aggregation) is defined as a set D given as:

$$D=\{S(k,x),S(k+x+1,y),S(k+x+y+2,z),\ldots,S(k_m,x_m)\}\forall (k_m,x_m)<N^c$$

To define a DLR segment, the ratio of the congested links to the total links length is greater than the CCR threshold. Since the function Ratio(S(k,x)) computes and returns the ratio value of the segment S(k,x), defining k and x based on congested road segments instead of all road segments results in different possible groupings.

Any function for aggregation may be used. The link aggregation function, Agg(k,x) generates a set of valid DLR segments D that may be obtained between link $l_k^c$ and $l_{k+x}^c$. Below is an example link aggregation function.

```
function Agg(k, x) is:
  1.Let D = ϕ, L^c = {l_1^c, l_2^c, l_k^c, . . . , l_{k+x}^c} ∀ L^c ∈ L
  2. if x < 1 or Ratio(S(k, x)) > CCR
    3. D = D ∪ S(k, x)
      4. return D
    5. else
        6. if x is odd: δ = x, else δ = x + 1
        7. D = D ∪ Agg(k, (x−1)/2) ∪ Agg(k + (x+1)/2, (δ−1)/2)
        8. return D
    end if
End Agg
```

This DLR segment aggregation algorithm applies a divide and conquer methodology to search through the set of congested links and find an optimal and/or maximum length DLR segment. Longer possible groups are tested first where any failing the test are then divided for testing. A hierarchal set of single divisions per previous possible grouping is applied.

The input is a set of contiguous segments. In line 1, the set of aggregated DLR segments D is initialized to null, and the set of congested links are initialized. In line 2, the ratio of the entire input collection of segments is tested against the CCR threshold. The check of x is to determine whether any more iterations are available. In line 3, the set of segments that can be aggregated is appended. If the ratio satisfies the CCR threshold, then the possible DLR segmentation is added as a DLR segmentation and the process is complete for that iteration. In line 5, the division process is started where the previously tested possible DLR segment did not satisfy the CCR threshold. In line 6, the division is performed. For an even number of segments, the division is in half. For an odd number of segments, the extra (e.g., middle segment of the failing group) is assigned to one of the two groups formed by the division. In line 7, the divided groups are formed. The failed grouping is divided in half, but division into a greater number of other groups may be used. For a second iteration, the entire chain of input segments is divided into half and each side passed separately and recursively back to the function. After any of the subsequent iterations (e.g., divisions, ratio calculations, and testing to the CCR threshold) indicate satisfaction of the CCR threshold, the possible grouping is added to D in line 8. The remaining segments or divisions continue to be tested until no further divisions are possible. The set of DLR segments that can be aggregated is appended into set D.

To generate or extract all sets of traffic segments (S(k,x)) from a strand or collection containing N number of links in L and $N^c$ number of congested links in $L^c\forall L^c\epsilon L$, the function call is Agg(1,$N^c$−1) in the example above. Other naming conventions or approaches may be used.

Figure 5:
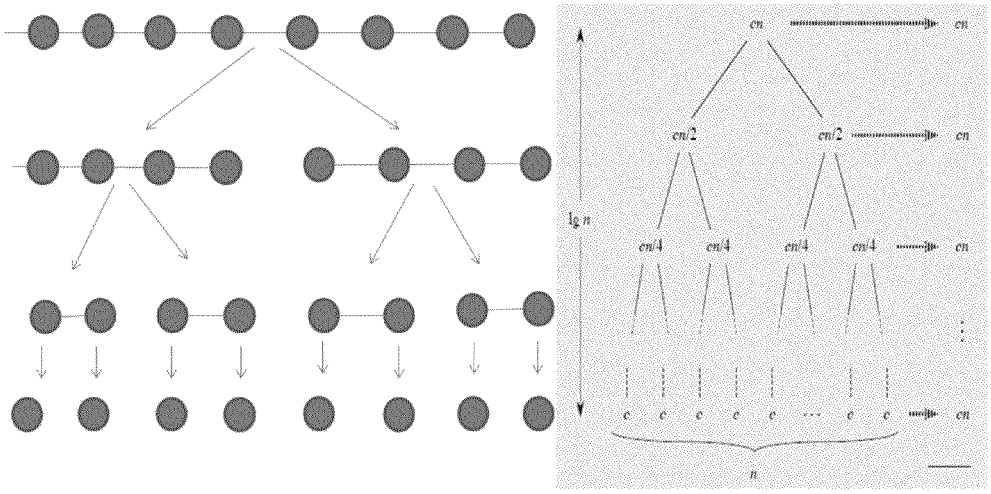
FIG. 5 illustrates an example divide-and-conquer approach for aggregation of a DLR segment.

FIG. 5 shows an example of the line 7 divide and conquer approach. In this example, none of the divisions satisfy the CCR threshold, so the return in the bottom line is of eight separate links or road segments. In other examples, one or more groups of two or more of the links may satisfy the CCR threshold, so are aggregated as DLR segments as members of D. For example, the first iteration in the top row fails the CCR threshold, so is divided in half. The right half passes the CCR threshold, so is added as an aggregate of four connected road segments to D. The left half fails the CCR threshold, so is divided, leading to the third row in FIG. 5. The process continues until all links are assigned to an aggregate or separately assigned as a DLR segment.

Limiting the divisions to possible groupings ending and beginning with congested links is expected to be fast in real-time, such as on the order of log(n) time complexity. This divide and conquer approach rather than sequential link adding may more quickly determine longer DLR segments associated with congestion and without iterating through all the links within each DLR segment.

An example of how the Aggregation function works is illustrated here for the possible segment bounded by $l^c_1$ and $l^c_2$. Calling function Agg(k,x) for Agg(1,1), the ratio (S(1,1))=50% as shown earlier fails the CCR test. Therefore, the aggregation algorithm proceeds to a divide and conquer. Since there are only two DLR links (the red links), δ=x+1=1+1=2. This possible segment is divided in half. In each half, the only possible division with begin and end points being congested links is the two congested links by themselves. Since each has a ratio of 100%, each passes the CCR threshold and is added to the collection of DLR segments as:

$$D = D \cup Agg\left(k, \frac{x-1}{2}\right) \cup Agg\left(k + \frac{x+1}{2}, \frac{\delta-1}{2}\right),$$

$$D = D \cup Agg\left(1, \frac{1-1}{2}\right) \cup Agg\left(1 + \frac{1+1}{2}, \frac{2-1}{2}\right),$$

representing $D = D \cup Agg(1, 0) \cup Agg(2, 0)$.

$D = \{S(1, 0), S(2, 0)\} = \{\{l_1^c\}; \{l_2^c\}\} \rightarrow$ Two *DLR* segments.

The above example starts with a simple case. To more efficiently use divide and conquer, the initial possible DLR segment is the entire collection or strand. In the example of FIG. 4, the aggregation algorithm is run on the whole link-set, calling the function Agg(1,5) where the possible DLR segment runs from $l^c_1$ at $l_2$ to $l^c_6$ at $l_{11}$ (x=5 results in 1+5=6). Using the equal length road segment assumption for simplicity of explanation, the Ratio(S(1,5))=6/11=55%. Since 55%>54%, the CCR test is passed and the algorithm therefore stops. There is only one DLR segment for the sample: $D=\{S(1,5)\}=\{l_1^c,l_2^c,l_3^c,l_4^c,l_5^c,l_6^c\}$. If the CCR threshold were 56%, then the whole segment would fail the CCR threshold. The result would be dividing into two. The right half would pass the CCR threshold due to 4 of the 5 road segments being congested. The left half would fail the CCR threshold due to only 2 of the 6 (or 2 of 4 or 5 depending on the definition of the possible DLR segment for the half) road segments being congested, so would fail the CCR threshold and be divided further, eventually resulting in two more DLR segments being added as merely the two remaining congested links.

The non-congested links $l_1$, $l_{3-4}$ and $l_6$ are then aggregated into three separate, connected DLR segments. Other approaches for dealing with remaining non-congested links not included in a congested DLR segment may be used.

Further processes for aggregation may be used. The division may be computationally efficient, but may result in sub-optimal aggregation. In some scenarios, contiguous DLR segments are separated into separate halves by the division iteration. Thus, leaving opportunity to aggregate the resultants segments further. A further test would be to determine whether any of the DLR segments resulting from the division approach should be combined or aggregated further. The DLR segments of the collection D may be joined into a fewer number of DLR segments.

One example join approach is represented as:

```
function Join(D1,D2) is:
    S_last (k1,x1) ∈ D1
    S_first (k2,x2) ∈ D2
    if (Ratio(S(k1,x1 + x2 + 1)) > CCR
        return (D1 − S_last) ∪ (D2 − S_first) ∪ S(k1,x1 + x2 + 1)
    else return D1 ∪ D2
end Join
```

The function Join acts on two separate ordered sets of DLR segments D1 and D2. The two set of DLR segments ($S_{last}$ in D1 and $S_{first}$ in D2) are combined to test if both together form a valid segment. The ratio is calculated and compared to the CCR threshold. If true, the two segments are aggregated into one, or else they are left separated. For non-congested DLR segments, the test is merely if the two segments are connected. If connected, then the DLR segments are joined into one.

Figure 6:
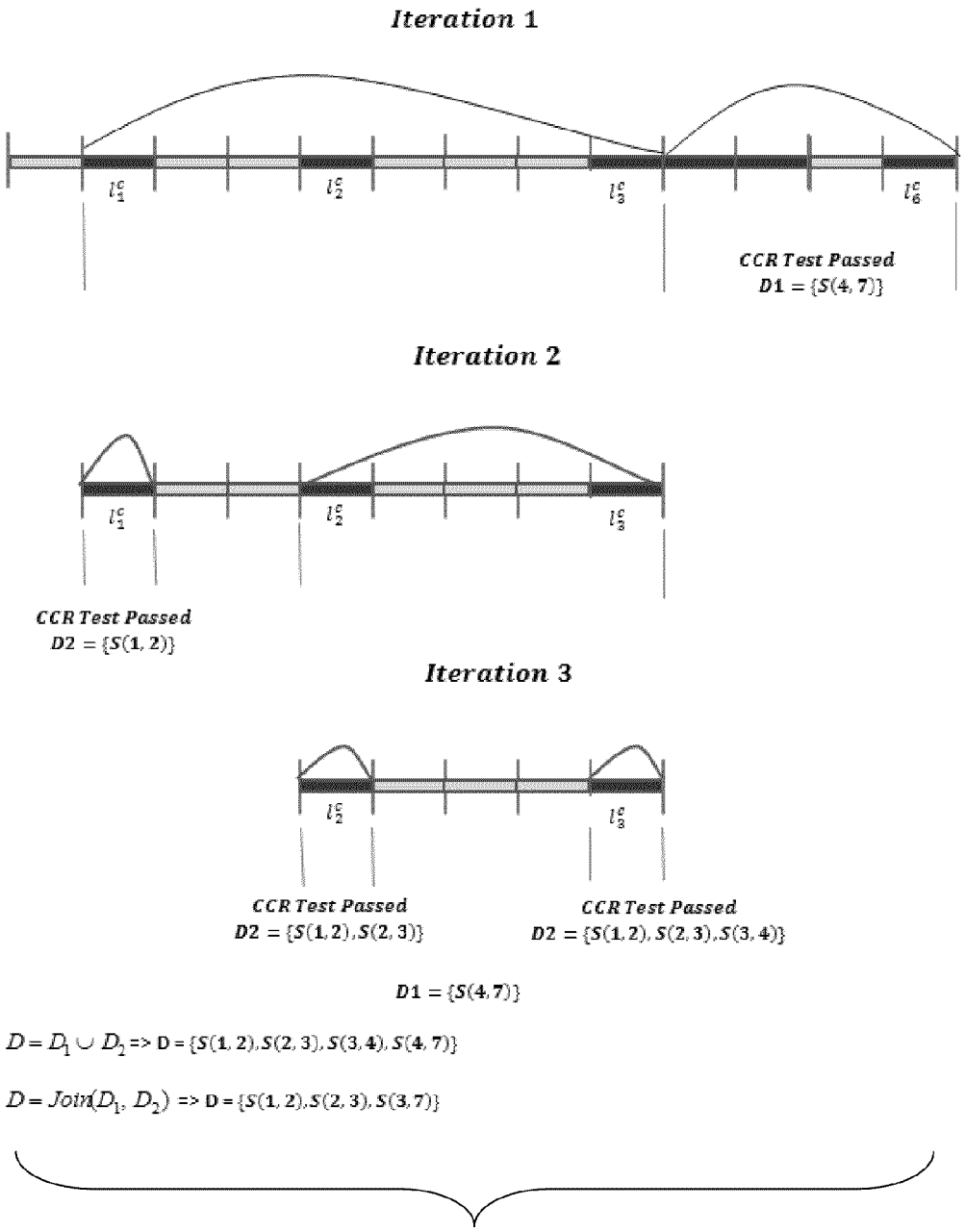
FIG. 6 illustrates an example of both divide-and-conquer and re-joining for aggregation of a DLR segment.

FIG. 6 shows example division, resulting in one DLR segment in the first iteration, one DLR segment in the second iteration, and two DLR segments in the third iteration. Three of the segments are single links. Due to the division, the single link segment of $l^c_3$ is connected to the multiple link DLR segment. By combining and testing, the combination satisfies the CCR threshold. The two DLR segments are joined, resulting in three DLR segments for congestion instead of four.

The join operation may be included in the aggregation function. An example of the aggregation function rewritten to include the join operation is provided as:

```
function Agg(k, x) is:
  1. Let D = ϕ, D1 = ϕ, D2 = ϕ
  2. L^c = {l1^c, l2^c, lk^c, . . . , l(k+x)^c} ∀ L^c ∈ L
  3. if x < 1 or Ratio(S(k, x)) > CCR
    4. D = D ∪ S(k, x)
    5. return D
  else
    6. D1 = D1 ∪ Agg(k, (x − 1)/2)
    7. D2 = D2 ∪ Agg(k + (x + 1)/2, (δ − 1)/2)
    8. D = D ∪ Join(D1, D2)
    9. return D
End Agg
```

Lines 1 and 2 initialize the join function by setting the different collections of DLR segments to null. Lines 2-7 are as described above in the aggregation function. Line 8 represents application of the join function to further aggregate the segments in the sets D1 and D2 if possible. Line 9 returns a final set of aggregated DLR segments.

Other joining approaches may be used. For example, join functions relying on information other than the ratio for CCR threshold comparison may be used, such as a simple joining by single link increment until more non-congested than congested links would be joined. Other integration of the join function in the aggregation function may be used, such as testing for join based only on being at a joining end in separate halves of a division.

Referring to FIG. 3, travel information is determined for each of the selected different groupings in act 20. The DLR segments represent sets of one or more links aggregated together. The aggregation is to simplify traffic reporting by having a given traffic flow or other travel information being reported for a fewer number of links in DLR.

The processor calculates a traffic value for each of the DLR segments. Since a DLR segment may include multiple road segments with different traffic information, the traffic information for the member road segments is combined. Each traffic value for a respective aggregated DLR segment is a function of the traffic information for the connected road segments included in the respective DLR segment.

In one embodiment, the traffic information is speed, travel time, or other measure of congestion. The traffic information from the different segments is averaged. A weighted average may be used where the weight is a function of the length of the corresponding road segment. For example, longer road segments are weighted more heavily, such as on a pro-rata basis.

In another embodiment, the travel value for the aggregated DLR segment is calculated from the length of the aggregated DLR segment and the traffic information. The speed along a length of each road segment and the length of the road segment are used to determine a travel time across the aggregated DLR segment. In alternative embodiments, a representative (e.g., median or maximum) traffic value is selected rather than combination.

In act 22, an indicator of the DLR segment and the traffic value for the DLR segment are output. Indicators for all or a sub-set of the DLR segments for one or more strands or collections of road segments are output. For example, DLR segments and corresponding traffic values are output for an entire route or map or for all road segments of a class or size along the route or in the map.

The indicator designates the DLR segment. For example, the latitude and longitude points of the beginning and end points of the DLR segment are output with or without shape points. The beginning and end points belong to different road segments or links (e.g., different edges of a directed map graph) where the DLR segment is aggregated from two or more connected road segments. Latitude and longitude points for intermediary road segments or non-terminal ends of the road segments relative to the aggregated DLR segment are not output to save processing and bandwidth. Where the DLR segment is a single road segment, then latitude and longitude points for both ends of the road segment are output. In the example of FIG. 2, the latitude and longitude for the beginning point of the link 757116820 (indexed as 14) is output with the ending point of the link 727451613 (indexed as 16) for the DLR segment 2 without other end points of the same and intermediary links. Other longitude and latitude information for a given DLR segment may be output, such as to define a shape. Other indicators than latitude and longitude may be used, such as an index reference (e.g., range of indexes) or a range of link identifiers.

Since one or more of the DLR segments may be aggregated from multiple road segments with similar congestion or density of congestion, a single traffic value or set of traffic information applicable to the entire DLR segment is output. For example, a speed of 30.6 kph is output for the DLR segment 1 and a speed of 11.4 kph (outlier 25 kph discarded from the average or 14.5 kph average is used instead) is output for the DLR segment 2. Only these two speeds are output for the strand or collection that includes six road segments. The travel information is output for the selected groupings or aggregates of road segments.

The output is from a server or source of traffic information. For example, a request for traffic information is received from a navigation device, personal computer, or entity using traffic information (e.g., BMW or delivery company). In response to the request, the traffic information is provided to the requestor or another entity associated with the requestor. The output is provided in an ongoing basis or just in response to a specific request. Any consumer of traffic information may receive the output for generating a map or route with traffic overlay information.

Traffic changes over time. To account for such changes, the DLR protocol provides for changes in traffic. Since the aggregation is based on congestion or other traffic information, the road segments included and excluded from a given DLR segment may be change. For example, the two DLR segments 1 and 2 shown in FIG. 2 are provided for the 14:50-14:55 period. For 14:55-15:00, a single DLR segment may be aggregated as most of the road segments become congested, three or more DLR segments may be aggregated due to greater variance of traffic for that time among the segments, and/or one or more road segments may be shifted to be aggregated in a different one of the DLR segments (e.g., link index 13 becoming congested so being included in DLR segment 1 instead of DLR segment 2.

Due to the changes over time, the identification of the traffic information is repeated since the traffic information may change or be different for different time periods. The aggregation is repeated since the aggregation uses the traffic information. The same road segments may be aggregated differently due to the change in traffic information. Similarly, the calculation of the traffic values for the aggregated DLR segments is repeated since the traffic information is used and/or since different DLR segments may result. The output is repeated to report the different DLR segments, different DLR segment traffic information, and/or change.

Any repetition frequency may be used. The output may be to the same device, such as to update a display with current information. The output may be to a different device. The output is provided in response to a request at a given time. For another time, the output is in response to a different device. Where the same strand may be used for outputs to different devices within a same update period, stored DLR segments aggregated for one device may be used for the output to the other device. Alternatively, the aggregation is performed separately for each request regardless of timing.

Figure 7:
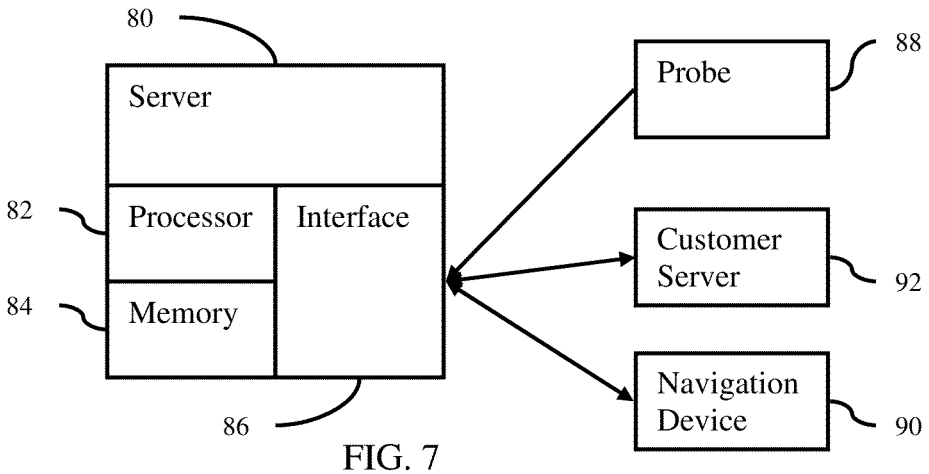
FIG. 7 illustrates an example system for aggregation of a DLR segment.

FIG. 7 illustrates an example system for DLR segment aggregation. The system includes a sever 80, a probe 88, a navigation device 90, and a customer server 92. Additional, different, or fewer components may be provided. For example, the navigation device 90, the probe 88, and/or a database may provide the traffic information, so one or two of these types of components may not be provided. As another example, multiple probes 88, multiple navigation devices 90, and/or multiple customer servers 92 are provided. In another example, a separate database of traffic information is provided and use by the server 80 to look-up or obtain traffic information for aggregation of road segments.

The server 80 is a server of a navigation database, mapping database, or traffic information supplier. For example, the server 80 is operated by Nokia, Google, Bing Traffic, Inrix Traffic, TomTom, Garmin, Waze or Clear Channel. In other embodiments, the server 80 is operated by a consumer of mapping or navigation databases.

The probe 88 is a road probe, optical camera, or other device for measuring traffic. Any now known or later developed probe for traffic measurements may be used. While one probe 88 is shown, a network of probes may be provided. The probe 88 provides traffic information for one or more road segments to the server 80 or another database of traffic information.

The navigation device 90 is a cellular phone, dedicated navigation device, vehicle mounted navigation system, personal computer, tablet, or other device determining location and displaying traffic information. Any now known or later developed navigation device may be used. While one navigation device 90 is shown, a network of navigation devices may be provided. The navigation device 90 provides traffic information, such as speed along road segments or location with time information. Alternatively or additionally, the navigation device 90 requests traffic information for a route, map, or location and generates a display of congestion or traffic flow with received information from the server 80.

The customer server 92 may be an intermediary with the navigation devices 90, so provides and/or receives traffic information from the server 80 for the navigation device 90. The customer server 92 is a third party provider of traffic information or may use mapping from the server 80 to determine traffic information received from another source or from the server 80.

The server 80, probe 88, customer server 92, and/or the navigation device 90 are coupled with each other for unidirectional or bi-directional communications through one or more networks. The phrase "coupled with" is defined to mean directly connected to or indirectly connected through one or more intermediate components. Such intermediate components may include hardware and/or software-based components.

In the embodiment of FIG. 7, the server 80 is shown with a processor 82, memory 84 and interface 86. These components perform the aggregation of road segments and calculation of traffic values for the resulting DLR segments. In other embodiments, the processor 82, memory 84 and/or interface 86 are provided in the navigation device 90 and/or the customer server 92. Other devices may perform the aggregation and/or calculation. In yet other embodiments, some of the aggregation and/or some of the traffic calculation are distributed among different parts of the system. In an alternative or additional approach, the aggregation is performed by one component (e.g., sever 80) and the calculation is performed by another component (e.g., customer server 92). Similarly, the identification of the road segments to be aggregated is performed by any one or combination of components.

The processor 82 may include a general processor, digital signal processor, an application specific integrated circuit (ASIC), field programmable gate array (FPGA), analog circuit, digital circuit, combinations thereof, or other now known or later developed processor. The processor 82 may be a single device or combinations of devices, such as associated with a network, distributed processing, or cloud computing.

The communication interface 86 may include any operable connection. An operable connection may be one in which signals, physical communications, and/or logical communications may be sent and/or received. An operable connection may include a physical interface, an electrical interface, and/or a data interface. For example, the interface 86 is a network interface card including hardware and software for digital and/or TCP/IP communications. The communication interface 86 provides for wireless and/or wired communications in any now known or later developed format.

The network interconnecting the components may include wired networks, wireless networks, or combinations thereof. The wireless network may be a cellular telephone network, an 802.11, 802.16, 802.20, or WiMax network. Further, the network may be a public network, such as the Internet, a private network, such as an intranet, or combinations thereof, and may utilize a variety of networking protocols now available or later developed including, but not limited to TCP/IP based networking protocols.

The memory 84 may be a volatile memory or a non-volatile memory. The memory 84 may include one or more of a read only memory (ROM), random access memory (RAM), a flash memory, an electronic erasable program read only memory (EEPROM), or other type of memory. The memory 84 houses or stores data for a database, such as a mapping database. While shown as part of the server 80, the memory 84 may be a separate database managed by a database server.

The memory 84 stores a map database or other navigation information. Traffic information is also stored. Alternatively or additionally, the memory 84 stores computer program code for one or more programs that configure the processor 82 to perform one or more of the acts of FIG. 3.

For example, the processor 82, based on instructions in the memory 84, is configured to combine road segments into groups based on dynamic traffic data. Separate probe or navigation device measures of road speed or other traffic data are obtained from the memory 84 or other components for each of the road segments. The processor 82 identifies the road segments from a received location or map region. Any input may be used to extrapolate, interpolate, or otherwise identify a collection of road segments. For example, a location and destination are received, so the processor 82 determines a route and corresponding road segments. Alternatively, the processor 82 identifies the road segments by receiving an indication of the collocation of road segments.

The processor 82 groups the road segments. By calculating a ratio or other function comparing the number, length, and/or other characteristics of road segments corresponding to congestion to road segments corresponding to no congestion (or other levels of congestion), the processor 82 combines road segments into groups of connected road segments with similar traffic flow. Any information may be used to determine congestion level, such as road speed. Different possible groups are combined to optimize the groupings. For example, dynamic traffic data representing traffic at a given time is used to assign congestion. Different possible groupings are tested in a largest first, then divide and conquer approach. The possible groupings are reduced in size iteratively until groups of road segments with similar traffic flow are found. Other tests may be performed by the processor 82, such as for joining separated groups.

The processor 82 or another processor calculates travel time, travel speed, or other indicator of congestion for the each of the combined road segments. The traffic information or assigned congestion level is used to determine the congestion for each of the combined road segments. The congestion is reported by transmittal and/or by storage for access by other devices.

The system of FIG. 7 allows the traffic consumers to use less processing power to digest the incoming traffic data. The aggregated DLR segments are reported to the traffic consumers rather than many more separate road segments. When DLR segments or links are aggregated, traffic reporting on non-TMC links becomes more efficient and more effective for both the traffic provider and the traffic consumer. After DLR aggregation, the traffic provider requires less server processing power to process DLR traffic data and less communication bandwidth.

Any traffic consumer may benefit from the traffic information provided in aggregated form. For example, first responders receive traffic information to aid with locating traffic accidents for assisting the injured as fast as possible and to locate and remove obstructions to keep roads safe.

The memory 84 may be a non-transitory computer-readable medium. While the non-transitory computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A method comprising:

identifying, in response to a requesting device, a plurality of connected road segments and corresponding traffic information for each of the connected road segments;

aggregating, by a processor, the connected road segments into a fewer number of dynamic location reference (DLR) segments than the plurality of the connected road segments, wherein aggregating comprises grouping the connected road segments into connected groups based on the traffic information;

calculating, by the processor, a traffic value for each of the DLR segments, each traffic value being a function of the traffic information for the connected road segments of the respective DLR segment, the traffic value comprising a speed, congestion level, travel time, traffic variance, or combinations thereof; and responding over a network connection to the requesting device with an indicator of the DLR segment and the traffic value for at least one of the DLR segments, the indicator having less data than data of the connected road segments and the respective traffic information for the connected road segments.

2. The method of claim 1, wherein the identifying comprises identifying a strand for a current location of a vehicle.

3. The method of claim 1, wherein the identifying comprises identifying a course for navigation.

4. The method of claim 1, wherein the identifying comprises identifying the connected road segments as not part of a traffic message channel segment.

5. The method of claim 1, wherein the identifying comprises identifying the corresponding traffic information as a probe measure of speed within an hour of a request for the traffic information or navigation measure of speed within the hour of the request for the traffic information.

6. The method of claim 1, wherein the grouping based on the traffic information comprises:

assigning a congestion label to a first set of the road segments having a characteristic of being congested and a non-congestion label to a second set of the road segments having a characteristic of being non-congested; and grouping as a function of a ratio of a sum of lengths of the road segments with the congestion label to a sum of lengths of the road segments with the non-congestion label.

7. The method of claim 6, wherein the grouping as the function of the ratio comprises grouping based on a comparison of the ratio for different possible groupings to a threshold.

8. The method of claim 7, wherein the grouping based on the comparison comprises grouping such that the different possible groupings all begin and end with the road segments having the congestion label.

9. The method of claim 7, wherein the grouping based on the comparison comprises comparing the ratio for all of the connected road segments with a threshold, comparing the ratios for each of a single division of the connected road segments, and comparing the ratios for each of another single division of at least one of the single divisions.

10. The method of claim 1, wherein the plurality of the connected road segments comprises at least five of the road segments, and wherein aggregating comprises aggregating the at least five road segments into at most two-thirds as many DLR segments.

11. The method of claim L wherein calculating comprises averaging the traffic information for the road segments of the DLR segment or calculating the travel value from a length of the DLR segment and the traffic information for the road segments of the DLR segment.

12. The method of claim 1, wherein responding comprises communicating the data of the indicator as end points of the DLR segment and the traffic value.

13. The method of claim 1, further comprising repeating the identifying of the traffic information for the connected road segments, the traffic information for the repetition being different than for previous traffic information, repeating the aggregating with the different traffic information such that different DLR segments for the same connected road segments are aggregated, repeating the calculating with the different DLR segments using the different traffic information, and repeating the responding with the different DLR segments.

14. An apparatus comprising:

at least one processor; and at least one memory including computer program code for one or more programs, the at least one memory and the computer program code configured to, with the at least one processor, cause the apparatus to perform at least the following, combine road segments into groups based on dynamic traffic data; and reporting a travel time or travel speed for the combined road segments.

15. The apparatus of claim 14, wherein the dynamic traffic data comprises separate probe or navigation device measures of road speed for each of the road segments, wherein the combined road segments are grouped as a function of a ratio of road segments corresponding to congestion and road segments corresponding to lack of congestion, the congestion and lack of congestion being a function of the road speed.

16. The apparatus of claim 14, wherein the road segments are combined by testing different groupings as a function of the dynamic traffic data in iterations from a largest grouping in a first iteration to divisions of the groupings in subsequent iterations and by joining resulting groupings after the iterations.

17. A non-transitory computer readable medium including instructions that when executed by a processor, instruct the processor to:

calculate a ratio of congested links to total for each of different groupings of a collection of road segments including the congested links and non-congested links, the road segments being based on a request from a navigation device;

selecting one or more of the different groupings, the selecting being a function of the ratios for the different groupings;

determine a speed, congestion level, travel time, traffic variance, or combinations thereof of vehicles for each of the selected different groupings; and responding, by the processor as part of a navigation or mapping server to the request from the navigation device for display on a display of the navigation device, with the speed, congestion level, travel time, traffic variance, or combinations thereof for the selected different groupings.

18. The non-transitory computer readable medium of claim 17, further comprising identifying the congested links and non-congested links as a function of travel speeds for the respective links, and wherein selecting comprises not selecting others of the different groupings.

* * * * *

UNITED STATES PATENT AND TRADEMARK OFFICE

CERTIFICATE OF CORRECTION

PATENT NO. : 9,230,436 B2
APPLICATION NO. : 14/073092
DATED : January 5, 2016
INVENTOR(S) : Fowe et al.

It is certified that error appears in the above-identified patent and that said Letters Patent is hereby corrected as shown below:

In the claims
Claim 11:
Column 19, Line 24 - delete "claim L" and insert --claim 1--.

Signed and Sealed this
Second Day of August, 2016

Michelle K. Lee

Michelle K. Lee
*Director of the United States Patent and Trademark Office*